US008893464B2

(12) United States Patent
Laemmermann et al.

(10) Patent No.: US 8,893,464 B2
(45) Date of Patent: Nov. 25, 2014

(54) MACHINE FOR PROCESSING ELONGATE STRAND-FORM MATERIAL

(75) Inventors: Helmut Laemmermann, Schwabach (DE); Rainer Vockentanz, Schwabach (DE)

(73) Assignee: Maschinenfabrik Niehoff GmbH & Co. KG, Schwabach (DE)

( * ) Notice: Subject to any disclaimer, the term of this patent is extended or adjusted under 35 U.S.C. 154(b) by 22 days.

(21) Appl. No.: 13/639,947

(22) PCT Filed: Jan. 27, 2011

(86) PCT No.: PCT/EP2011/000374

§ 371 (c)(1), (2), (4) Date: Jan. 7, 2013

(87) PCT Pub. No.: WO2011/124291

PCT Pub. Date: Oct. 13, 2011

(65) Prior Publication Data

US 2013/0133304 A1 May 30, 2013

(30) Foreign Application Priority Data

Apr. 9, 2010 (DE) ..... 10 2010 014 356

(51) Int. Cl.
*D01H 7/26* (2006.01)
*D07B 3/10* (2006.01)
*D07B 7/12* (2006.01)

(52) U.S. Cl.
CPC ..... *D07B 3/103* (2013.01); *D01H 7/26* (2013.01); *D07B 2401/401* (2013.01); *D07B 2401/406* (2013.01); *D07B 7/12* (2013.01)
USPC ..... 57/115

(58) Field of Classification Search
CPC ..... D01H 7/26; D01H 7/28; D01H 7/30
USPC ..... 57/115, 58.3, 58.36, 58.38
See application file for complete search history.

(56) References Cited

U.S. PATENT DOCUMENTS 3,793,819 A 2/1974 Madalozzo
5,509,260 A 4/1996 Derdeyn (Continued)

FOREIGN PATENT DOCUMENTS

EP 1441063 7/2004
JP 53-028743 3/1978

(Continued)

OTHER PUBLICATIONS

Japanese Office Action in Japanese Patent Application No. 2013-503018 issued on Mar. 17, 2014 and an English translation thereof.

*Primary Examiner* — Shaun R Hurley
(74) *Attorney, Agent, or Firm* — Greer, Burns & Crain, Ltd.

(57) ABSTRACT

A machine is provided for processing elongate strand-form material, having a rotatably mounted rotor bow which is used to twist the strand-form material and, proceeding from a cross-sectional area, extends in the direction of a longitudinal axis. In the direction of this longitudinal axis, the rotor bow extends in a curved manner at least in portions. In this direction, the rotor bow has a longitudinal groove extending substantially orthogonal to this cross-sectional area. At least regions of this longitudinal groove are covered by at least one guide element. In this rotor bow, the strand-form material is guided movably in the direction of the longitudinal axis. The present rotor bow is preferably made of plastics, preferably reinforced with fibers.

10 Claims, 2 Drawing Sheets

(56) References Cited

U.S. PATENT DOCUMENTS

| | | | | |
|---|---|---|---|---|
| 5,809,763 | A | 9/1998 | Rowlands | |
| 6,223,513 | B1 * | 5/2001 | Post et al. | 57/115 |
| 6,289,661 | B1 | 9/2001 | Boland | |
| 6,865,875 | B2 * | 3/2005 | Watkins | 57/115 |
| 7,121,076 | B2 * | 10/2006 | Priegelmeir et al. | 57/118 |
| 7,165,387 | B2 * | 1/2007 | Voge et al. | 57/115 |
| 2004/0172932 | A1 | 9/2004 | Watkins | |
| 2006/0000198 | A1 | 1/2006 | Priegelmeir et al. | |
| 2006/0196163 | A1 | 9/2006 | Voge et al. | |

FOREIGN PATENT DOCUMENTS

| | | |
|---|---|---|
| JP | 11256489 | 9/1999 |
| JP | 2002-242086 | 8/2002 |
| JP | 2006519941 | 8/2006 |
| JP | 2008537024 | 9/2008 |
| JP | 2010106392 | 5/2010 |
| WO | 95/04185 | 2/1995 |

* cited by examiner

MACHINE FOR PROCESSING ELONGATE STRAND-FORM MATERIAL

BACKGROUND

The present invention relates to a machine for processing elongate strand-form material comprising a rotatably mounted rotor bow. The invention furthermore relates to a method for manufacturing such a rotor bow.

Machines having a rotatably mounted rotor bow for processing elongate strand-form material are known from the prior art. Such machines are used to process leads, wires, threads or strings into cables or ropes and are called cording or stranding machines, generally differentiated between single-twist and double-twist machines. Although the invention will be described in the following using the example of a double-twist stranding machine, it is noted that the invention also relates to all other types of machines using a rotor bow of the described type.

All known embodiments of double-twist stranding machines concur to the extent that the elongate strand-form material is guided over a rotor or stranding bow, that two strand points are provided and twice as many strand twists are produced as rotor bow revolutions. Reference is made in this regard to EP 1 441 063 A1 and WO 95/04185.

The operational principle of the described double-twist stranding machines provides for the rotor bow to rotate about an axis. Double-twist stranding machines are used predominantly for manufacturing mass-produced goods such as electrical cable for the automobile industry, for example, and therefore have an accordingly very high processing speed coupled with a high rotational speed of the rotor bow, amounting to several thousand revolutions per minute.

Double-twist stranding machines are often integrated into production lines; i.e. so-called in-line production. In this type of processing, production steps upstream and downstream of the double-twist stranding machine are necessary in manufacturing the end product. In the manufacture of electrical cable, insulating the cable is for example downstream of stranding. If just one element of the production chain fails, the entire production line comes to a halt and high downtime costs ensue. Hence, formidable demands are placed on a double-twist stranding machine's functional reliability.

Rotatably mounted rotor bows often consisting of a high-strength metallic material have to date been used in double-twist stranding machines, as have rotor bows designed as very complex hollow body profiles as disclosed for example in U.S. 2006/0196163 A1.

SUMMARY

The object of the invention is that of providing a machine having a rotatably mounted rotor bow for processing elongate strand-form material with increased machine functional reliability as well as a method for manufacturing a rotor bow in accordance with the invention.

The machine for processing elongate strand-form material comprises a rotatably mounted rotor bow. Same serves in twisting the strand-form material and extends, based on cross-sectional area, in the direction of a longitudinal axis. The rotor bow extends at least partially in a curved manner in the direction of this longitudinal axis. In this direction the rotor bow exhibits a longitudinal groove extending substantially right-angled to this cross-sectional area.

At least one guide element covers at least portions of the longitudinal groove. The strand-form material is movably guided in the direction of the longitudinal axis in the rotor bow. The rotor bow according to the invention essentially consists of plastic, preferably fiber-reinforced.

The term "cross-sectional area of the rotor bow" refers to an area arranged substantially perpendicular to the longitudinal axis of said rotor bow and describing at least portions of the rotor bow's cross-section at least sectionwise. The rotor bow extends at right angles to its cross-sectional area. The cross-sectional area can vary along the rotor bow's longitudinal axis.

A term "rotor bow" refers to an elongated sectionwise curved, component. The curvature of the rotor bow can result from individual sharp bends, whereby the rotor bow extends in straight or curved manner between two consecutive sharp bends. The term "sharp bend" refers to a bending of relatively low bending radius, preferably $r<100$ mm. The rotor bow can exhibit a continuous bending in the direction of the longitudinal axis within one area and can extend in another area without bending; the bending radius can thereby be variable. The described design of the rotor bow enables the elongate strand-form material to be twisted. The rotor bow is preferably rotatably mounted in the area of its ends and is thus pivotable, particularly about a rotational axis.

A longitudinal groove is to be understood as a recess in this rotor bow which substantially extends in the direction of the longitudinal axis. The longitudinal groove is thereby provided to guide the elongate strand-form material in the direction of the rotor bow's longitudinal axis.

A guide element is to be understood as a component at least partially covering this longitudinal groove. A guide element is provided to securely guide the elongate strand-form material within the longitudinal groove.

The term "plastic with fiber reinforcement" refers to a material having at least a percentage of matrix material and a percentage of reinforcing fibers.

The reinforcing fibers can thereby consist of inorganic materials such as basalt, boron, glass, ceramic or silica; of metallic materials such as steel, aluminum or titanium as well as metal alloys; of natural materials such as wood, flax, hemp or sisal or preferably of organic materials such as aramid, carbon, polyester, nylon, polyethylene or Plexiglas.

The reinforcing fibers employed can be of different fiber lengths. Short fibers having a fiber length of 0.1 to 1 mm are preferably used, these reinforcing fibers can be particularly advantageously utilized when the rotor bow is manufactured by injection molding. Using long fibers having a length of 1 to 50 mm is particularly preferential, particularly in combination with a thermosetting matrix material. Long fibers particularly result in increasing the stability and rigidity of the fiber-reinforced plastic. Using continuous fibers longer than 50 mm is highly particularly preferential. Continuous fibers are particularly employed in the form of rovings or weaves. A plastic having been fiber-reinforced by means of continuous fibers satisfies the highest demands, particularly with respect to stability and rigidity.

The orientation of the reinforcing fibers in the matrix material can particularly influence the deformational behavior and/or the stability of the fiber-reinforced plastic. The reinforcing fibers are preferably of irregular, multi-directional arrangement within the matrix material. This results in a uniformly rigid and/or stable fiber-reinforced plastic in virtually all spatial directions. The reinforcing fibers are preferably aligned pursuant the rotor bow's known operational demands. This results in the reinforcing fibers being in a multi-directional or preferably unidirectional orientation such that the rotor bow exhibits predefinable deformational behavior in its main direction of stress.

The matrix material of a fiber-reinforced plastic preferably comprises as a component a thermoplastic plastic such as polyetheretherketone (PEEK), polyphenylensulfide (PPS), polysulfone (PSU), polyetherimide (PEI) or polytetrafluorethene (PTFE) or preferentially a thermosetting plastic such as epoxy resin (EP), unsaturated polyester resin (UP), vinyl ester resin (VE), phenol-formaldehyde resin (PF), diallylphthalate resin (DAP), methacrylate resin (MMA), polyurethane (PUR) or amino resin.

The volumetric proportion of reinforcing fibers to matrix material is preferably adapted to the rotor bow's expected operational demands and allowable deformation. A high percentage of longer fibers particularly results in increased rigidity and stability. A fiber-reinforced plastic preferably exhibits a fiber content of 3 to 95 vol %, preferentially 60-80 vol %, and particularly preferentially 65-70 vol %.

In one preferred embodiment, the rotor bow consists of a plastic without fiber reinforcement.

In one preferred embodiment, the cross-sectional area of the rotor bow exhibits a first and a second axis. Said first and second axis are preferably at right angles to one another. In particular, said first and second axis essentially constitute the two half-axes of an ellipse. The cross-sectional area is preferably substantially symmetrical to the first axis and/or the second axis. Due to its cross-sectional area, a rotor bow in accordance with the invention essentially exhibits an equal drag coefficient in particular in both direction perpendicular to the direction of the longitudinal axis, particularly in both directions, and can thereby be employed in particular independently of the rotational direction. This thereby lowers the risk of failure during rotor bow use and thus particularly increases the double-twist stranding machine's operational reliability.

In one preferred embodiment, the rotor bow comprises a longitudinal groove. The design of this longitudinal groove is partly determined by a longitudinal groove cross-sectional area which preferably lies in a common plane with the cross-sectional area of the rotor bow. The longitudinal groove extends from said longitudinal groove cross-sectional area in the direction of the longitudinal axis of the rotor bow. The longitudinal groove cross-sectional area preferably intersects the first axis of the rotor bow's cross-sectional area and is in particular symmetrical to the second axis of said cross-sectional area. This design in particular protects the elongate strand-form material during rotation such that it is only minimally subjected to, in particular external stress, such as for example air currents. This protection of the strand-form material in particular increases the operational reliability of the double-twist stranding machine.

In one preferred embodiment, at least portions of the surface of the longitudinal groove exhibit a coating. At least portions of the longitudinal groove are preferably provided with a wear-reducing and/or friction-enhancing coating. Increasing the friction to $\mu>0.1$ at the longitudinal groove surface particularly achieves being able to affix a sliding material to the surface of the longitudinal groove in non-slip manner. The non-slip anchoring particularly increases the double-twist stranding machine's operational reliability. At least portions of the surface of the longitudinal groove are preferentially provided with a wear- and/or friction-reducing coating. The friction-reducing coating particularly achieves having the elongate strand-form material be able to slide in the longitudinal groove at a coefficient of friction of $\mu>0.1$. This low coefficient of friction increases the double-twist stranding machine's operational reliability.

In a further preferred embodiment, the surface of the longitudinal groove is not provided with any coating.

In another preferred embodiment, the surface of the longitudinal groove is provided with a slide plate. The slide plate is in particular composed of a friction and/or wear-reducing material. Said slide plate preferably reduces the coefficient of friction between the elongate strand-form material and the slide plate to $\mu<0.1$. The slide plate is preferably composed of a metallic material. A slide plate in particular prevents wear caused by the sliding of the elongate strand-form material from damaging the rotor bow's structure and thus reducing the component strength. A slide plate thus particularly increases the double-twist stranding machine's operational reliability.

In one preferred embodiment, the double-twist stranding machine comprises a rotor bow having a guide element made from a wear- and/or friction-reducing material. Said guide element is preferably manufactured from a metallic or preferentially ceramic material. The guide element particularly comprises at least a percentage of silicon carbide, preferably of aluminum oxide and particularly preferentially of zirconium oxide. A low-wear and friction-reducing guide element particularly increases the double-twist stranding machine's operational reliability, since the elongate strand-form material is particularly only slightly heated when sliding by the guide element. A further advantage of this embodiment compared to others is that the strand-form material is less stressed and stretched.

In one preferred embodiment, a guide element is detachably affixed to the rotor bow by a fixing element. The guide element is preferably fixed by means of a pin, preferentially a rivet or particularly preferentially a screw. The guide element is preferably fixed by means of 1 to 4 fixing elements, preferentially 2 to 3 and particularly preferentially 2 fixing elements such as e.g. screws. The detachable connection between the guide element and the rotor bow allows the guide element to be easily and safely replaced and thus prevents its continued use despite having experienced excessive wear. The operational reliability of the double-twist stranding machine is thereby increased. In a further design according to the invention, the guide element is connected to the rotor bow by material engagement.

In one preferred embodiment, the guide element covers sections of the longitudinal groove such that a total cross-sectional area having a substantially closed strand-form material guiding recess is formed in the covered area. This design of the strand-form material guiding recess can prevent the strand-form material from unintentionally exiting the longitudinal groove. The operational reliability of the double-twist stranding machine is particularly increased by the secure guiding of the strand-form material within the longitudinal groove.

In one preferred embodiment, at least one of the fixing means does not project beyond the total cross-sectional area. A fixing means is preferably inserted into the rotor through bow by the guide element and no longer projects from the guide element after the affixing of the guiding elements has concluded. The fixing element is preferably a screw and the guide element has a recess for receiving a fixing means. The rotor bow is less weakened by the arrangement of the recess in the guide element than by arranging the recess in the rotor bow. The rotor bow thus exhibits less reduced component strength.

A fixing means is preferably inserted into the guide element through the rotor bow and no longer projects from the rotor bow after the of the affixing guide element has been concluded. In one preferential embodiment, the fixing means is a screw and the rotor bow comprises a recess for receiving the screw head and the guide element comprises a threaded portion. Thus, a particularly stable screw connection ensues in particular from the high stability of the guide element and the operational reliability of the double-twist stranding machine is increased.

In a further preferred embodiment, the guide elements are positioned such that the strand-form material is deflected by the same angle, particularly in order to follow the path of the longitudinal groove at least at two consecutive guide elements. This manner of positioning the guide elements results in substantially equal stress on preferably a plurality of, but at least two guide elements. The equal stressing of structurally identical guide elements preferably gives rise to similar wear such that checking one guide element allows inferring the state of wear of multiple guide elements and thus simplifies their replacement. The operational reliability of the double-twist stranding machine is particularly increased by the simplified replacement of the guide elements. This manner of positioning the guide elements allows the use of fewer guide elements which on the one hand reduces the number of parts subject to wear and on the other lengthens the open, uncovered distance between guide elements. When the elongate strand-form material slides through the longitudinal groove and/or through a guide element, particles can break off from the strand-form material and/or from the sliding surfaces and deposit on the rotor bow; copper or tin dust in particular deposits on the rotor bow. The air flow resulting from the rotational movement can advantageously remove these particles from the open uncovered sections of the rotor bow. Thus, the described manner of positioning the guide elements increases the operational reliability of the double-twist stranding machine.

In one method according to the invention of manufacturing a rotor bow, particularly for use in a double-twist stranding machine, a rotor bow according to the invention is first manufactured from a plastic, particularly with fiber reinforcement, with a guide element thereafter being affixed to same.

One preferred embodiment of the manufacturing method in particular comprises the steps of master forming and curing, or cooling respectively, of said rotor bow. Particularly to be understood by master forming is bringing the fiber-reinforced plastic into a shape which preferably substantially constitutes the negative form of the rotor bow. The matrix material and the reinforcing fibers are preferably introduced into the negative form together, particularly by injection molding. Preferentially, the matrix material and the reinforcing fibers are introduced into the negative form separately from one another.

By curing, or cooling respectively, it is to be understood that the rotor bow essentially has the desired mechanical properties, particularly in terms of its rigidity and stability, particularly once this process has been concluded.

By affixing of a guide element is to be understood that the guide element is connected in formfit war to the rotor bow, for example by means of a fixing element, or that it is connected by material engagement to the rotor bow. The term "fixing element" preferably refers to a rivet or a screw. Preferably, a guide element is affixed to the rotor bow by means of two fixing elements, particularly preferentially by means of two screws.

BRIEF DESCRIPTION OF THE DRAWINGS

Further advantages, features and application possibilities of the present invention will ensue from the following description provided in conjunction with the figures. It is showing.

DETAILED DESCRIPTION

Figure 1:
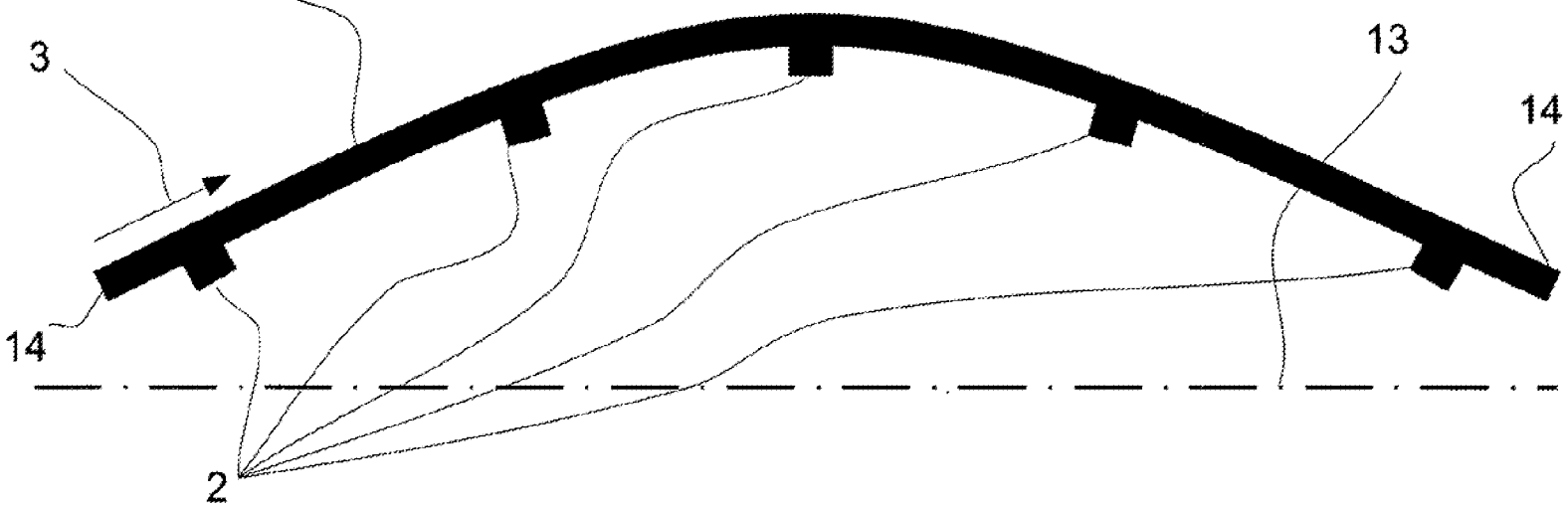
FIG. 1 a rotor bow 1 for use in a double-twist stranding machine, wherein same comprises a number of guide elements 2, FIG. 2 the cross-sectional area 4 of a rotor bow 1 having a first axis 5 and a second axis 6, FIG. 3 the total cross-sectional area 4 comprising a strand-form material guiding recess 6, wherein the longitudinal groove cross section 10 is a part of same, and two fixing elements 15.

FIG. 1 depicts a rotor bow 1 for use in a double-twist stranding machine. Guide elements 2 are affixed to the rotor bow 1. The rotor bow 1 extends in the direction of the longitudinal axis 3, right-angled to its cross-sectional area 4 (not shown) and exhibits a bend in its middle region. The rotor bow 1 is rotatably mounted in the region of its ends 14 and can rotate about the rotational axis 13.

Figure 2:
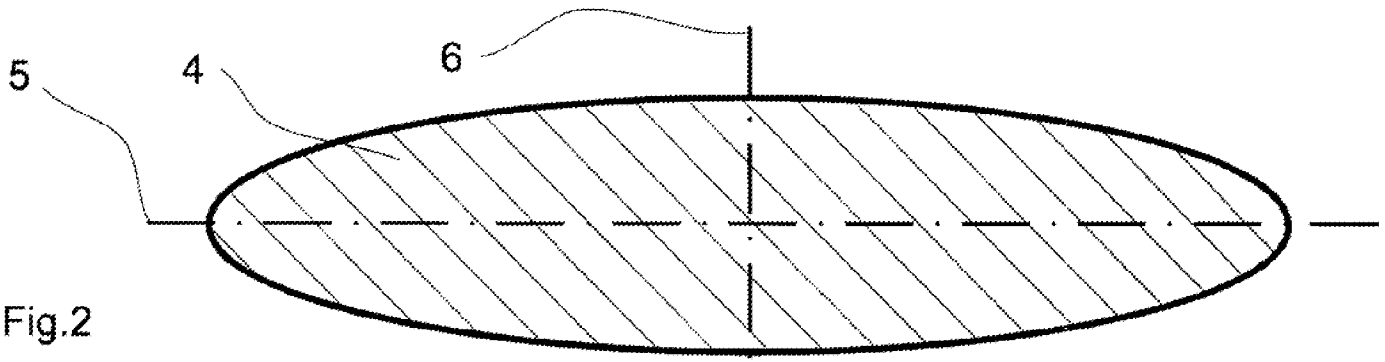

FIG. 2 depicts the cross-sectional area 4 of the rotor bow 1. The cross-sectional area 4 has a first axis 5 and a second axis 6. The cross-sectional area 4 is symmetrical to these two axes 5 and 6. The depicted cross-sectional area 4 essentially exhibits the basic form of an ellipse.

Figure 3:
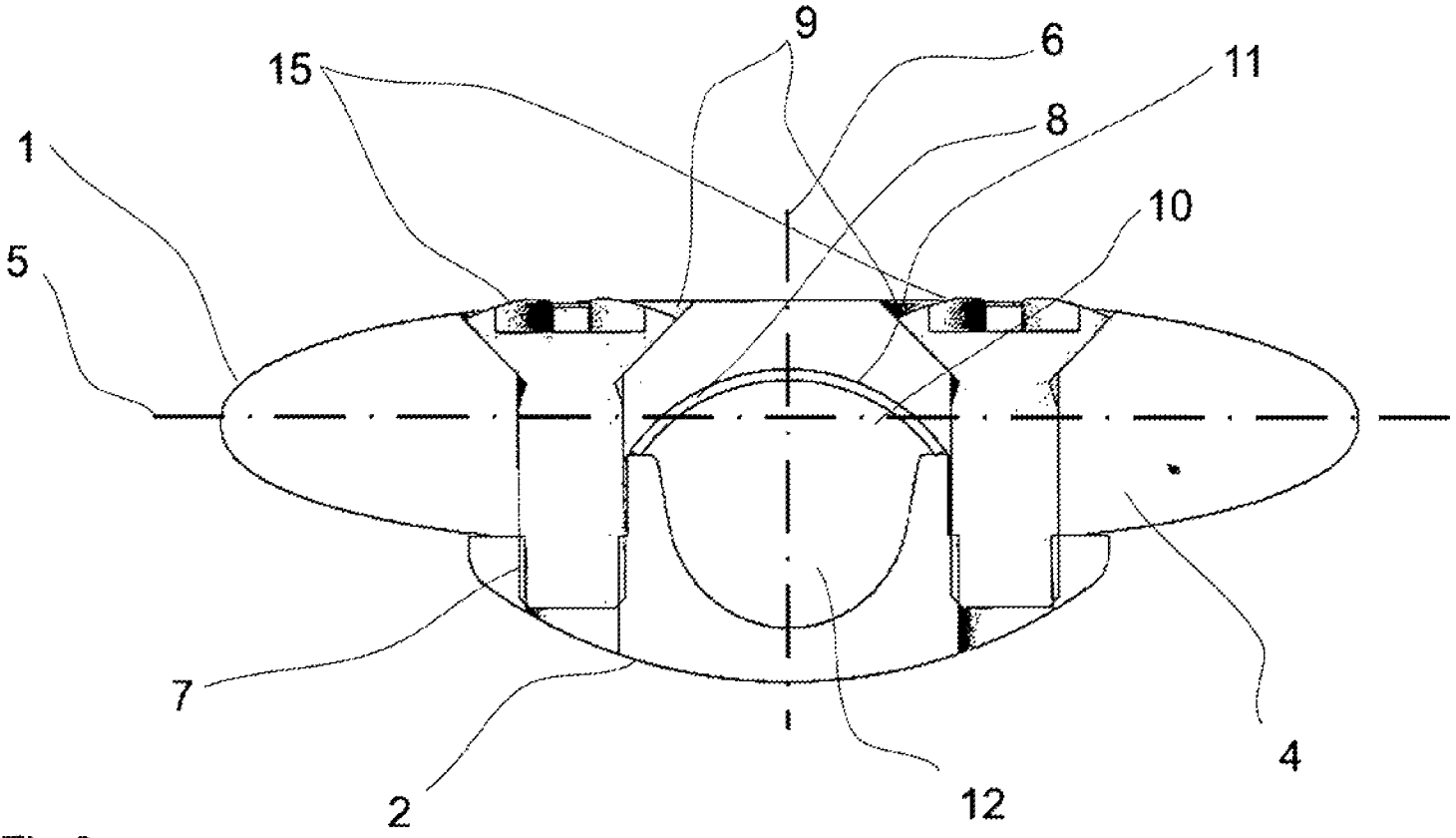

FIG. 3 depicts the total cross-sectional area of the rotor bow, which is comprised by the cross-sectional area 4 of the rotor bow and the cross-sectional area of the guide element 2. In the depicted plane, the guide element 2 covers the longitudinal groove cross-sectional area 10 so as to form a closed strand-form material guiding recess 12. The surface of the longitudinal groove 11 is covered in part by a sliding plate 8. The guide element 2 comprises two threaded sections 7 for receiving the fixing screws 15. The fixing screws 15 are introduced through the rotor bow 1 into the guide element 2 and connected thereto, the heads of the fixing screws 15 thereby being substantially accommodated within the recesses 9 of the rotor bow 1. The longitudinal groove cross-sectional area 10 intersects the first axis 5 and is symmetrical to the second axis 6. This design of the longitudinal groove cross-sectional area 10 ensures that the strand-form material (not shown) is well protected within the longitudinal groove against external influences, for example air currents, during rotational movement.

The invention claimed is:

1. A machine for processing elongate strand stock, comprising:

a rotatably mounted rotor bow, which serves to twist the strand stock, with:

an extension substantially along a longitudinal axis, at least sections of which are curved;

a cross-section described by a cross-sectional area and extending substantially right-angled to the longitudinal axis;

a longitudinal groove extending substantially parallel to the longitudinal axis and having its cross-section described by a longitudinal groove cross-sectional area, wherein the strand stock can be movably guided in the direction of the longitudinal axis in said longitudinal groove of the rotor bow;

the rotor bow consisting of plastic reinforced with fibers and being formed as a solid body profile, at least one guide element being provided which covers the longitudinal groove cross-sectional area over at least portions of the longitudinal extension of said longitudinal groove and which is adapted for guiding the strand stock, and said cross-sectional area exhibiting a substantially elliptical basic form.

2. The machine in accordance with claim 1, wherein portions of the longitudinal groove cross-sectional area are intersected by a first semi-axis of the elliptical basic form and is symmetrical to a second semi-axis of the elliptical basic form.

3. The machine in accordance with claim 1, wherein at least portions of the surface of the longitudinal groove are provided with a coating, wherein said coating is composed of a wear-reducing and/or friction-reducing material.

4. The machine in accordance with claim 1, wherein at least portions of the surface of the longitudinal groove are provided with a slide plate, wherein at least sections of same consist of a wear-reducing and/or friction-reducing material.

5. The machine in accordance with claim 1, wherein at least sections of the at least one guide element consists of at least one of a wear-reducing and a friction-reducing material.

6. The machine in accordance with claim 1, wherein the at least one guide element is detachably affixed on the rotor bow by means of at least one fixing element.

7. The machine in accordance with claim 6, wherein a total cross-sectional area having a circumferentially closed strand stock guiding recess is formed in the covered area.

8. The machine in accordance with claim 6, wherein the at least one fixing element is substantially disposed within the total cross-sectional area.

9. The machine in accordance with claim 1, wherein the rotor bow has at least two guide elements which are positioned such that the angle of deflection by which the strand stock is deflected at a guide element to follow the path of the longitudinal groove is the same at two consecutive guide elements.

10. A method of manufacturing a rotatably mounted rotor bow for use in a machine for processing elongate strand stock in accordance with claim 1, the rotor bow, which serves to twist the strand stock, having:

an extension substantially along a longitudinal axis, at least sections of which are curved;

a cross-section described by a cross-sectional area and extending substantially right-angled to said longitudinal axis;

a longitudinal groove extending substantially parallel to said longitudinal axis and having its cross-section described by a longitudinal groove cross-sectional area, wherein the strand stock can be movably guided in the direction of the longitudinal axis in said longitudinal groove of the rotor bow;

at least one guide element which covers the longitudinal groove cross-sectional area over at least portions of the longitudinal extension of said longitudinal groove and which is adapted for guiding the strand stock, in which the rotor bow with the longitudinal groove is manufactured from plastic reinforced with fibers as a solid body profile, the cross-sectional area exhibiting an elliptical basic form, and in which the at least one guiding element is connected to the rotor bow.

* * * * *